US008049692B2

(12) United States Patent
Kim et al.

(10) Patent No.: US 8,049,692 B2
(45) Date of Patent: Nov. 1, 2011

(54) COMMON VOLTAGE GENERATION CIRCUIT AND LIQUID CRYSTAL DISPLAY COMPRISING THE SAME

(75) Inventors: Taek-young Kim, Anyang-si (KR); Kang-yeon Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 765 days.

(21) Appl. No.: 11/565,078

(22) Filed: Nov. 30, 2006

(65) Prior Publication Data

US 2007/0164963 A1 Jul. 19, 2007

(30) Foreign Application Priority Data

Jan. 19, 2006 (KR) ..... 10-2006-0005928

(51) Int. Cl.
*G09G 3/36* (2006.01)

(52) U.S. Cl. ..... 345/87; 345/98

(58) Field of Classification Search ..... 345/87–102, 345/38, 50

See application file for complete search history.

(56) References Cited

U.S. PATENT DOCUMENTS 5,638,087 A * 6/1997 Tanaka et al. ..... 345/87
2005/0200588 A1* 9/2005 Kaneda ..... 345/98
2006/0132415 A1* 6/2006 Yu ..... 345/98

FOREIGN PATENT DOCUMENTS

JP 2001201732 A * 7/2001

* cited by examiner

*Primary Examiner* — Kevin M Nguyen
*Assistant Examiner* — Kenneth B Lee, Jr.
(74) *Attorney, Agent, or Firm* — F. Chau & Associates, LLC

(57) ABSTRACT

A common voltage generation circuit includes a common voltage adjusting circuit adjusting a level of a common voltage in response to a compensation signal and providing the adjusted common voltage to a liquid crystal panel, and a common voltage compensating circuit including a resistor producing potential differences between the adjusted common voltage and each of the positive and negative polarity data voltages, a first voltage detector detecting a potential difference between the adjusted common voltage and the negative polarity data voltage, a second voltage detector detecting a potential difference between the adjusted common voltage and the positive polarity data voltage, and a voltage comparator comparing output signals of the first and second voltage detectors and feeding the compensation signal back to the common voltage adjusting circuit.

10 Claims, 6 Drawing Sheets

COMMON VOLTAGE GENERATION CIRCUIT AND LIQUID CRYSTAL DISPLAY COMPRISING THE SAME

CROSS-REFERENCE TO RELATED PATENT APPLICATION

This application claims priority to Korean Patent Application No. 10-2006-0005928, filed on Jan. 19, 2006, the disclosure of which is herein incorporated by reference in its entirety.

BACKGROUND OF THE INVENTION

1. Technical Field

The present disclosure relates to a common voltage generation circuit and a liquid crystal display circuit comprising the same.

2. Discussion of Related Art

A liquid crystal display (LCD) is a type of flat panel display for displaying images using liquid crystals. In general, LCDs feature low power consumption, slim, lightweight design, with low driving voltage.

A conventional LCD includes a color fitter display panel having reference electrodes and color filters, a thin film transistor (TFT) substrate having TFTs and pixel electrodes, and a liquid crystal layer sandwiched between the color filter display substrate and the TFT substrate. An LCD displays images by applying electric potentials to the pixel electrodes and the reference electrodes to generate an electric field in the liquid crystal layer to control the alignment of the liquid crystal molecules and the quantity of light transmitted is controlled.

In conventional LCDs, in order to reduce or prevent deterioration of a liquid crystal layer, polarity inversion of a liquid crystal voltage is periodically performed within each frame, which is called a frame inversion driving method. The liquid crystal voltage is determined by a data voltage applied to a data driver and a common voltage corresponding to the data voltage.

In recent years, several attempts have been made to improve the display quality of LCD devices. In polarity inversion, a positive-polarity voltage and a negative-polarity voltage, for a gray scale, are applied alternately to each pixel. Polarity inversion, however, necessitates different common voltages for the respective liquid crystal panels, due to various reasons, such as parasitic capacitance generated during fabrication of a thin film transistor, characteristics of the thin film transistor, voltage uniformity in common voltage generating electrodes, or a structural difference between each of the circuit components.

A flicker phenomenon occurs due to a data voltage distortion, that is, the positive-polarity data voltage and the negative-polarity data voltage being asymmetric with respect to the common voltage. To minimize the occurrence of the flicker phenomenon a common voltage generation circuit may employ a digital variable resistor to enable an inspector to adjust a flickering level directly at an inspection stage. The time for adjusting the flickering level may vary depending on the inspector's skill. In addition, since the flickering level is observed with the naked eyes, quantitative control of the flickering level is less than satisfactory. Further, measurement errors may be introduced due to an inspector's physical fatigue or other ambient conditions.

SUMMARY OF THE INVENTION

According to an exemplary embodiment of the present invention, there is provided a common voltage generation circuit including a common voltage adjusting circuit adjusting a level of a common voltage in response to a compensation signal and providing the adjusted common voltage to a liquid crystal panel, and a common voltage compensating circuit including a resistor producing potential differences between the adjusted common voltage and each of the positive and negative polarity data voltages, a first voltage detector detecting a potential difference between the adjusted common voltage and the negative polarity data voltage, a second voltage detector detecting a potential difference between the adjusted common voltage and the positive polarity data voltage, and a voltage comparator comparing output signals of the first and second voltage detectors and feeding the compensation signal back to the common voltage adjusting circuit.

According to an exemplary embodiment of the present invention, there is provided a liquid crystal display comprising a liquid crystal panel including a plurality of unit pixels defined at an intersecting area of each of a plurality of gate lines and each of a plurality of data lines, a timing controller generating control signals for controlling the liquid crystal panel, a driving voltage generator receiving the control signals and generating a plurality of driving voltages, wherein the driving voltage generator includes a common voltage adjusting circuit adjusting a level of a common voltage in response to a compensation signal and providing the adjusted common voltage to a liquid crystal panel and a resistor producing potential differences between the adjusted common voltage and each of the positive and negative polarity data voltages, a first voltage detector detecting a potential difference between the adjusted common voltage and the negative polarity data voltage, a second voltage detector detecting a potential difference between the adjusted common voltage and the positive polarity data voltage, and a voltage comparator comparing output signals of the first and second voltage detectors and feeding the compensation signal back to the adjusted common voltage adjusting circuit, a gate driver receiving the driving voltage and applying the driving voltage to the plurality of the gate lines; and a data driver applying the data voltage to the plurality of the data lines.

BRIEF DESCRIPTION OF THE DRAWINGS

The present invention will become readily apparent to those of ordinary skill in the art when descriptions of exemplary embodiments thereof are read with reference to the accompanying drawings.

DESCRIPTION OF EXEMPLARY EMBODIMENTS

Figure 1:
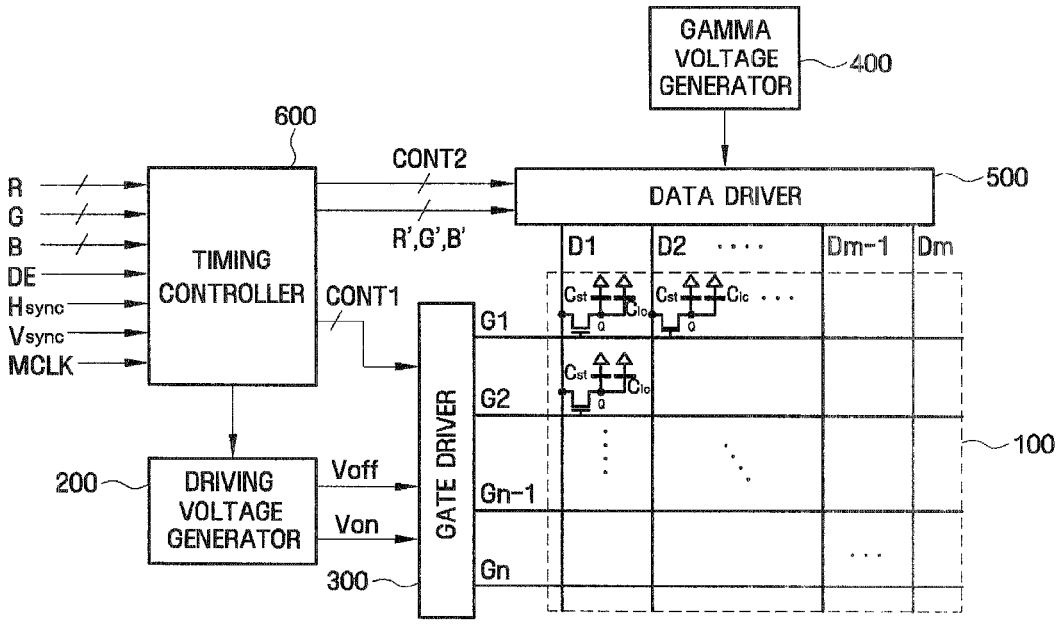
FIG. 1 is a block diagram of a liquid crystal display according to an exemplary embodiment of the present invention.

Hereinafter, exemplary embodiments of the present invention will be described in detail with reference to the accompanying drawings. Like reference numerals refer to similar or identical elements throughout the description of the figures.

Hereinafter, a liquid crystal display (LCD) according to an exemplary embodiment of the present invention will be described with reference to FIG. 1.

FIG. 1 is a block diagram of a LCD according to an exemplary embodiment of the present invention. Referring to FIG. 1, the LCD includes a liquid crystal panel 100, a driving voltage generator 200, a gate driver 300, a gamma voltage generator 400, a data driver 500, and a timing controller 600.

As shown in FIG. 1, the liquid crystal panel 100 includes a plurality of unit pixels which are electrically connected to a plurality of display signal lines G1-Gn and D1-Dm and arranged substantially in the form of a matrix. The display signal lines G1-Gn and D1-Dm include a plurality of gate lines G1-Gn transmitting gate signals and a plurality of data lines D1-Dm transmitting data signals. The gate lines G1-Gn extend substantially in a row direction in FIG. 1 and are substantially parallel to each other, while the data lines D1-Dm extend substantially in a column direction and are substantially parallel to each other.

Each of the plurality of pixels comprises a switching element Q, which is electrically connected to a corresponding one of the plurality of display signal lines G1-Gn and D1-Dm, and a liquid crystal capacitor $C_{lc}$. Each of the plurality of pixels may include a storage capacitor $C_{st}$ which is electrically connected to the switching element Q. If desired, the storage capacitor $C_{st}$ may not be formed.

The switching element Q is provided on a thin film transistor (TFT) substrate. The switching element Q includes a control terminal which is electrically connected to one of the gate lines G1-Gn, an input terminal which is electrically connected to one of the data lines D1-Dm, and an output terminal which is electrically connected to both the liquid crystal capacitor $C_{lc}$ and the storage capacitor $C_{st}$.

The liquid crystal capacitor $C_{lc}$ includes a pixel electrode provided on the TFT substrate and a common electrode provided on a color filter substrate. A liquid crystal layer disposed between the two electrodes functions as the dielectric of the liquid crystal capacitor $C_{lc}$. The pixel electrode is electrically connected to the switching element Q. The common electrode, which is electrically connected to the common voltage $V_{com}$, may be formed on the entire surface of the color filter substrate. The common electrode may be provided on the TFT substrate, and both electrodes may be bar or stripe shaped.

The storage capacitor $C_{st}$ may be defined by the overlap of the pixel electrode and a separate wire (not shown) provided on the TFT substrate and applied with a predetermined voltage such as the common voltage $V_{com}$ (separate wire type). The storage capacitor $C_{st}$ may be defined by the overlap of the pixel electrode and its previous gate line via an insulator (previous gate type).

For color display each pixel can represent a color by providing one of a plurality of red (R), green (G) and blue (B) color filters in an area corresponding to the pixel electrode. The color filter may be provided in the corresponding area of the color filter substrate. The color filters may be provided on or under the pixel electrode on the TFT substrate.

A polarizer or polarizers (not shown) may be attached to either or both of the TFT substrate and the color filter substrate of the liquid crystal panel 100.

The driving voltage generator 200 generates a plurality of driving voltages. For example, the driving voltage generator 200 generates a gate-on voltage Von, a gate-off voltage Voff, and a common voltage $V_{com}$. The driving voltage generator 200 may further comprise a common voltage generator 20 including a common voltage adjusting unit 40 and a common voltage compensating unit 50. The common voltage adjusting unit 40 adjusts a voltage level of the common voltage $V_{com}$ in response to a compensation signal. The common voltage compensating unit 50 compares the positive polarity voltage with the negative polarity voltage to determine whether the positive polarity voltage and the negative polarity voltage are symmetric with respect to the common voltage $V_{com}$, and feeds a comparison result back to the common voltage adjusting unit 40. This will be described in more detail later in this disclosure with reference to FIG. 2.

The gate driver 300, which is electrically connected to the gate lines G1-Gn of the liquid crystal panel 100, applies gate signals from an external device to the gate lines G1-Gn, each gate signal being a combination of a gate-on voltage Von and a gate-off voltage Voff.

The gamma voltage generator 400 generates two sets of a plurality of gray-scale voltages related to the transmittance of the pixels. The data voltages in one set have a positive polarity with respect to the common voltage $V_{com}$, while those in the other set have a negative polarity with respect to the common voltage $V_{com}$. The positive-polarity data voltages and negative-polarity data voltages are alternately supplied to the liquid crystal panel 100 during inversion driving.

The data driver 500, which is electrically connected to the data lines D1-Dm of the liquid crystal panel 100, selects the gray-scale voltages from the gamma voltage generator 400 for application as data signals to the data lines D1-Dm. The data driver 500 may include a plurality of integrated circuits (ICs).

The timing controller 600 generates control signals for controlling the gate driver 300, the data driver 500, and other components, and supplies the generated control signals to the corresponding elements.

Hereinafter, operations of the LCD will be described in detail.

The timing controller 600 receives RGB image signals R, G and B and input control signals controlling the display thereof, such as for example, a vertical synchronization signal $V_{sync}$, a horizontal synchronization signal $H_{sync}$, a main clock CLK and a data enable signal DE, from an external graphic controller (not shown). The timing controller 600 generates a plurality of gate control signals CONT1, and a plurality of data control signals CONT2, and processes the image signals R, G and B for the liquid crystal panel 100 on the basis of the input control signals. The timing controller 600 provides the gate control signals CONT1 for the gate driver 400, the data control signals CONT2 and the processed image signals R', G' and B' for the data driver 500.

The gate control signals CONT1 include a vertical synchronization start signal STV for informing of start of a frame, a gate clock signal CPV for controlling the output time of the gate-on voltage Von and an output enable signal OE for defining the widths of the gate-on voltage Von.

The data control signals CONT2 include a horizontal synchronization start signal STH for informing of start of a horizontal period, a load signal LOAD for instructing to apply the appropriate data voltages to the data lines D1-Dm, an inversion control signal RVS for reversing the polarity of the data voltages with respect to the common voltage $V_{com}$, and a data clock signal HCLK.

The data driver 500 receives a packet of the image data R', G' and B' for a pixel row from the timing controller 600 in response to the data control signal CONT2 received from the timing controller 600 and converts the image data R', G' and B' into data voltages selected from the gray-scale voltages.

Responsive to the gate control signals CONT1 from the timing controller 600, the gate driver 300 applies the gate-on voltage Von to the gate line G1-Gn, thereby turning on the switching elements Q connected thereto.

The data driver 500 applies the data voltages to the corresponding data lines D1-Dm during a turn-on time of the switching elements Q due to the application of the gate-on voltage Von to the gate lines G1-Gn that are electrically connected to the switching elements Q, which is called "one horizontal period" or "1H" and is equal to one period of the horizontal synchronization signal $H_{sync}$, the data enable signal DE, and the data clock signal CPV. Then, the data voltages are supplied to the corresponding pixels via the turned-on switching elements Q.

The liquid crystal molecules in the liquid crystal capacitor $C_{lc}$ have orientations depending on the variation of the electric field that is generated by the pixel electrode and the common electrode, and the molecular orientations determine the polarization of light passing through the liquid crystal layer. A polarizer or polarizers (not shown) may be attached to either or both of the TFT substrate and the color fitter substrate.

By repeating this procedure, all of the gate lines G1-Gn are sequentially supplied with the gate-on voltage Von during a frame, thereby applying the data voltages to all pixels. When the next frame starts after finishing one frame, the inversion control signal RVS applied to the data driver 500 may be controlled such that the polarity of the data voltages is reversed, which is called "frame inversion". The inversion control signal RVS may be controlled such that the polarity of the data voltages flowing in a data line in one frame is reversed, which is called "line inversion", or such that the polarity of the data voltages in one packet is reversed, which is called "dot inversion".

Figure 2:
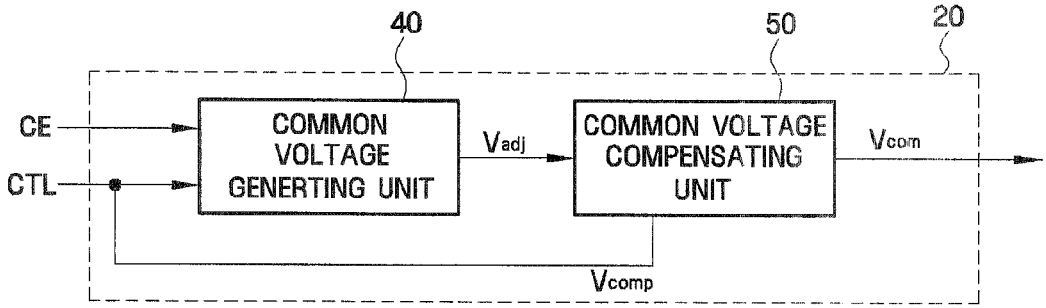
FIG. 2 is a block diagram of a common voltage generator according to an exemplary embodiment of the present invention.

FIG. 2 is a block diagram of a common voltage generator 20 according to an embodiment of the invention. Referring to FIG. 2, the common voltage generator 20 includes a common voltage adjusting unit 40 and a common voltage compensating unit 50.

At an initial operating stage, the common voltage adjusting unit 40 receives a control enable signal CE and a control signal CTL from an external device and is initialized for operation. Once the operation of the common voltage adjusting unit 40 is initialized, the common voltage adjusting unit 40 adjusts the common voltage $V_{com}$ in response to a compensation signal $V_{comp}$, which is output from the common voltage compensating unit 50, and provides the adjusted result, that is, the common voltage Vcom of the common voltage compensating unit 50, to the liquid crystal panel 100.

The common voltage compensating unit 50 receives the common voltage adjusted signal $V_{adj}$ which is output from the common voltage adjusting unit 40, compares the positive polarity voltage with the negative polarity voltage to determine whether the positive polarity voltage and the negative polarity voltage are symmetric with respect to the output signal $V_{adj}$, and feeds a comparison result back to the common voltage adjusting unit 40. In an exemplary embodiment of the present invention, the output signal $V_{adj}$ of the common voltage adjusting unit 40 is the same as the common voltage $V_{com}$.

Figure 3:
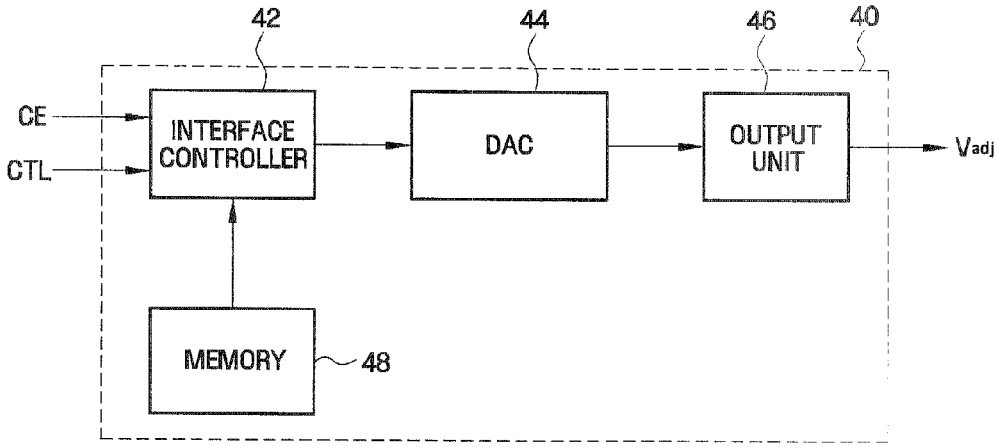
FIG. 3 is an internal block diagram of a common voltage adjusting unit according to an exemplary embodiment of the present invention.

FIG. 3 is an internal block diagram of a common voltage adjusting unit 40 according to an exemplary embodiment of the present invention. Referring to FIG. 3, the common voltage adjusting unit 40 includes an interface controller 42, a digital-to-analog converter (DAC) 44, an output unit 46, and a memory 48.

At an initial operating stage, the interface controller 42 receives a control enable signal CE and a control signal CTL from an external device, reads intermediate data stored in the memory 48 according to the control signal CTL, and delivers the read data to the DAC 44. Once the operation of the interface controller 42 is initialized, the interface controller 42 delivers the intermediate data stored in the memory 48 to the DAC 44 according to the compensation signal $V_{comp}$ which is output from the common voltage compensating unit 50. In addition, the interface controller 42 may modify the intermediate data stored in the memory 48 according to the control signal CTL.

The control enable signal CE enables the common voltage adjusting unit 40 and is connected to an operating voltage $V_{DD}$(not shown). At this time, to disable the common voltage adjusting unit 40, the control enable signal CE is connected to a ground terminal. At an initial operating stage, the control signal CTL is applied from the timing controller 600. The control signal CTL and the compensation signal $V_{comp}$ are pulse signals having a logic high level and a logic low level.

At an initial operating stage, the DAC 44 outputs an analog voltage value corresponding to the intermediate data read in the memory 48 according to the control signal CTL. Once the operation of the DAC 44 is initialized, the DAC 44 outputs analog voltage values according to the compensation signal $V_{comp}$ which is output from the common voltage compensating unit 50.

The output unit 46 amplifies the analog voltage values and outputs the amplified voltage values, that is, the adjusted output signal $V_{adj}$.

The memory 48 stores the intermediate data of bit data, for example, "1000000" as intermediate data of 7-bit data, at an initial stage. The memory 48 is a programmable memory. In an exemplary embodiment of the present invention, the memory 48 is an Electrically Erasable Programmable Read Only Memory (EEPROM).

Figure 4:
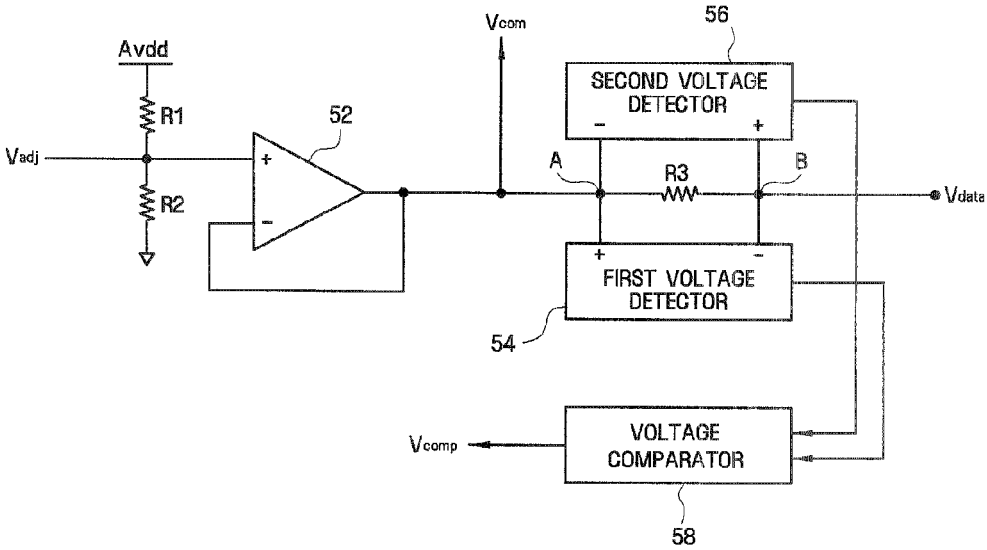
FIG. 4 is an internal block diagram of a common voltage compensating unit according to an exemplary embodiment of the present invention.

FIG. 4 is an internal block diagram of a common voltage compensating unit 50 according to an exemplary embodiment of the present invention. Referring to FIG. 4, the common voltage compensating unit 50 includes an amplifier 52, first and second voltage detectors 54 and 56, and a voltage comparator 58.

The amplifier 52 comprises an operating amplifier OP1 including resistors R1 and R2 connected to the non-inverting terminal (+). The non-inverting terminal (+) of the operating amplifier OP1 is supplied with a driving voltage $A_{vdd}$ and a dropped voltage of the adjusted output signal $V_{adj}$ which is output from the common voltage adjusting unit 40. The inverting terminal (−) of the operating amplifier OP1 is connected to the output terminal of the amplifier 52, and the output signal of the amplifier 52 is fed back to the operating amplifier OP1 through the inverting terminal (−) thereof. Here, the amplifier 52 amplifies the output signal of the common voltage adjusting unit 40, that is, the adjusted output signal $V_{adj}$, which is the same as the common voltage $V_{com}$ applied to the liquid crystal panel 100.

When the positive polarity data voltage and the negative polarity data voltage are symmetric with respect to the common voltage, no potential difference is created between opposite ends A and B of a resistor R3. On the other hand, when the positive polarity data voltage and the negative polarity data voltage are not symmetric with respect to the common voltage, a potential difference is created between the opposite ends A and B of the resistor R3. Here, the first and second voltage detectors 54 and 56 detect the potential difference created between the opposite ends A and B of the resistor R3.

The first voltage detector 54 detects and outputs a difference between the common voltage $V_{com}$ of the adjusted level output from the common voltage adjusting unit 40 and the negative polarity data voltage which is output from the data driver 500. One end of the resistor R3 is connected to the output terminal of the amplifier 52 and the other end thereof is connected to the output terminal $V_{data}$ of the data driver 500.

The second voltage detector 56 detects and outputs a difference between the common voltage $V_{com}$ of the adjusted level output from the common voltage adjusting unit 40 and the positive polarity data voltage which is output from the data driver 500.

Here, in order to determine an order of detecting by the first and second voltage detectors 54 and 56, a switch (not shown) may be disposed between the first and second voltage detectors 54 and 56.

The voltage comparator 58 compares output signals of the first and second voltage detectors 54 and 56, and feeds a comparison result that is, a compensation signal $V_{comp}$, back to the common voltage adjusting unit 40. If the output compensation signal $V_{comp}$ is at a logic high level, the logic high level signal is fed back as the control signal CTL of the common voltage adjusting unit 40, so that the common voltage adjusting unit 40 pulls-up the level of the common voltage $V_{com}$ according to the compensation signal $V_{comp}$. Conversely, if the output compensation signal $V_{comp}$ is at a logic low level, the logic low level signal is fed back as the control signal CTL of the common voltage adjusting unit 40, so that the common voltage adjusting unit 40 pulls-down the level of the common voltage $V_{com}$ according to the compensation signal $V_{comp}$.

As described above, in an exemplary embodiment of the present invention, the common voltage $V_{com}$, the positive polarity data voltage, and the negative polarity data voltage are compared with one another, and a compensation signal is output as the comparison result, which is fed back to the common voltage adjusting unit 40, thereby automatically optimizing the common voltage $V_{com}$ such that the positive polarity data voltage and the negative polarity data voltage are symmetric with respect to the common voltage $V_{com}$. In an exemplary embodiment of the present invention since the common voltage $V_{com}$ is automatically optimized, a flicker phenomenon that occurs due to asymmetry of the positive polarity data voltage and the negative polarity data voltage with respect to the common voltage $V_{com}$ can be automatically adjusted.

Figure 5:
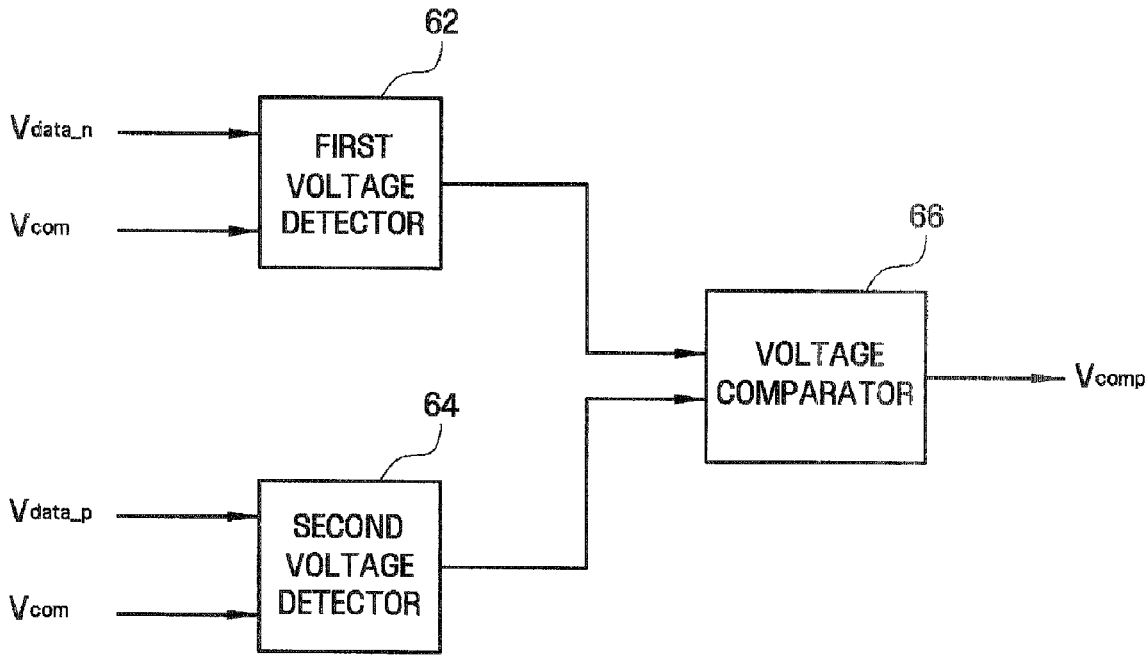
FIG. 5 is an internal block diagram of a common voltage compensating unit according to an exemplary embodiment of the present invention.

FIG. 5 is an internal block diagram of a common voltage compensating unit 50 according to an exemplary embodiment of the present invention. Referring to FIG. 5, the common voltage compensating unit 50 includes first and second voltage detectors 62 and 64 and a voltage comparator 66.

The first voltage detector 62 detects and outputs a difference between the common voltage $V_{com}$ of the adjusted level output from the common voltage adjusting unit 40 and the negative polarity data voltage $V_{data_n}$ that is output from the data driver 500.

The second voltage detector 64 detects and outputs a difference between the common voltage $V_{com}$ of the adjusted level output from the common voltage adjusting unit 40 and the positive polarity data voltage $V_{data_p}$ that is output from the data driver 500.

The voltage comparator 66 compares output signals of the first and second voltage detectors 62 and 64 and feeds a comparison result, that is, a compensation signal $V_{comp}$, back to the common voltage adjusting unit 40.

Figure 6:
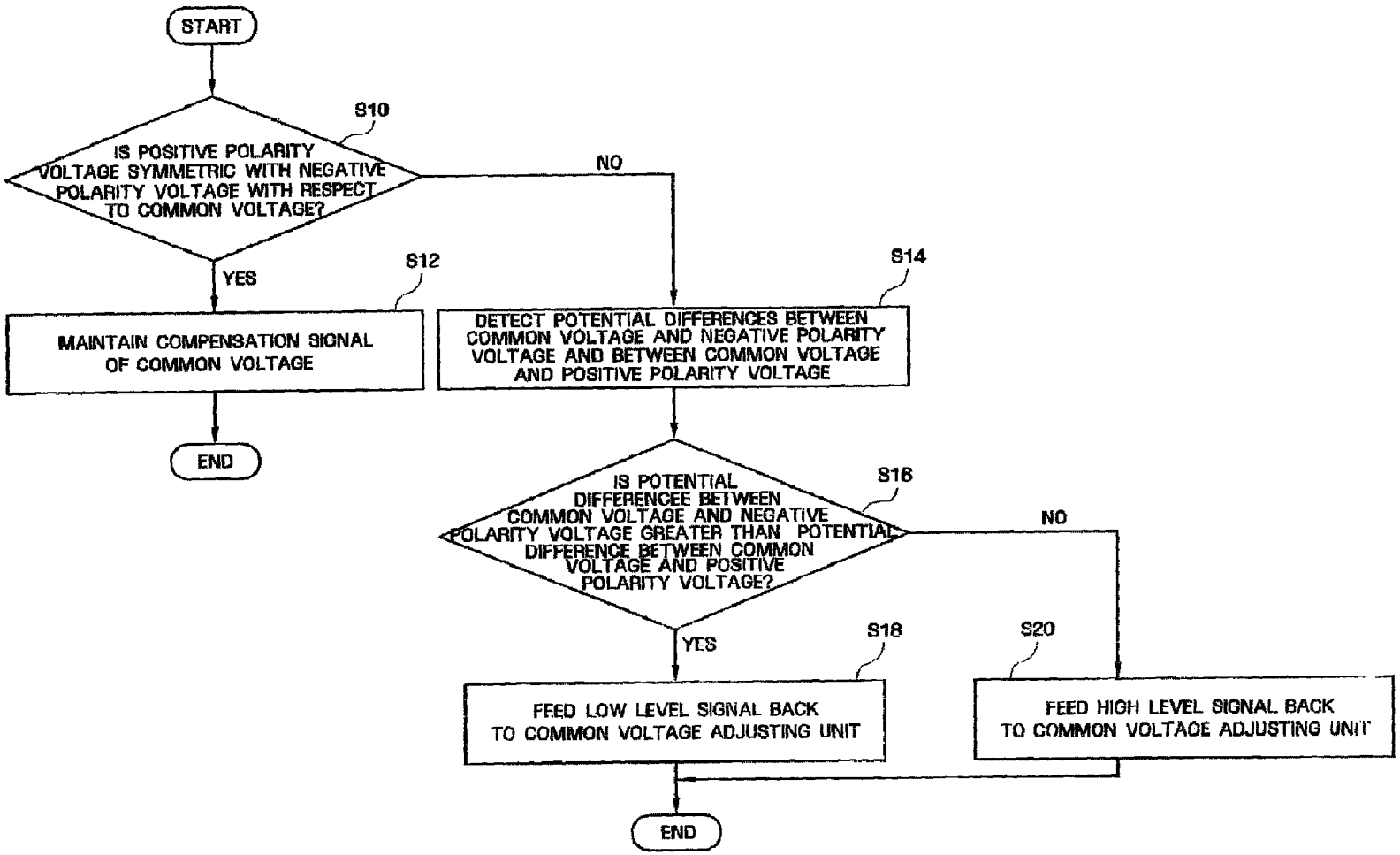
FIG. 6 is a flow chart showing operations of the common voltage adjusting unit according to an exemplary embodiment of the present invention.
Figure 7:
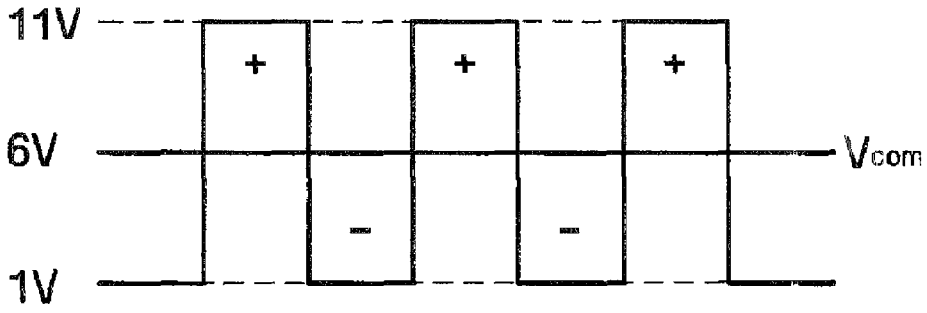
FIGS. 7 through 9 are waveform diagrams of data voltages according to an exemplary embodiment of the present invention.
Figure 8:
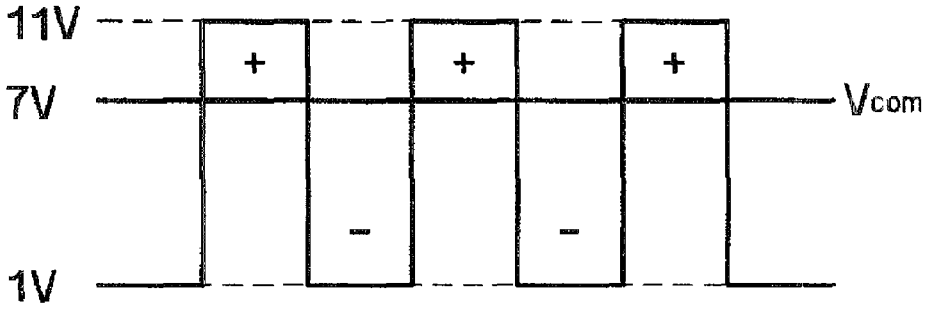
Figure 9:
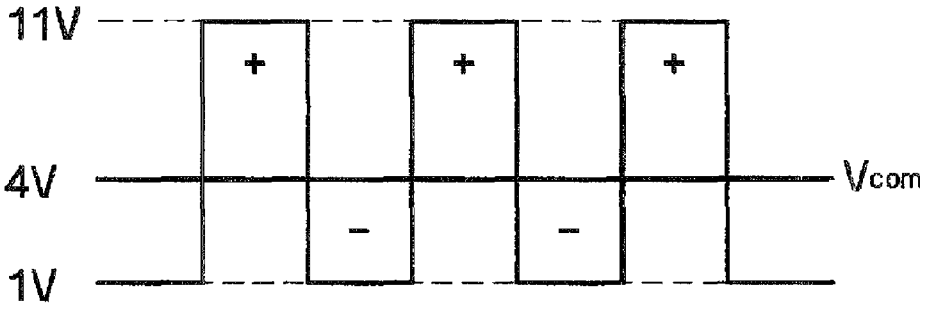

FIG. 6 is a flow chart showing operations of the common voltage adjusting unit 40 according to an exemplary embodiment of the present invention. FIGS. 7 through 9 are waveform diagrams of data voltages according to an exemplary embodiment of the present invention.

As shown in FIG. 6, in operation S10, the positive polarity voltage is compared with the negative polarity voltage to determine whether data voltages that are output from the data driver 500 are symmetric with respect to the common voltage $V_{com}$ of the adjusted level output from the common voltage adjusting unit 40. If a comparison result shows that the positive polarity voltage and the negative polarity voltage are symmetric with each other with respect to the common voltage $V_{com}$ as shown in FIG. 7 the compensation signal $V_{comp}$, which is output from the common voltage compensating unit 50, is maintained in operation S12.

However, when the positive polarity voltage and the negative polarity voltage are not symmetric with each other with respect to the common voltage $V_{com}$ as shown in FIGS. 8 and 9, a potential difference is created between opposite ends A and B of the resistor R3 shown in FIG. 4. In operation S14, a difference between the common voltage $V_{com}$ and the negative polarity data voltage is detected by the first voltage detector 54, and white a difference between the common voltage $V_{com}$ and the positive polarity data voltage is detected by the second voltage detector 56.

In operation S16, output signals of the first and second voltage detectors 54 and 56 are compared with each other to determine whether the output signal of the first voltage detector 54 is greater than that of the second voltage detector 56. If the comparison result of operation S16 shows that the output signal of the first voltage detector 54 is greater than that of the second voltage detector 56, as shown in FIG. 8, the voltage comparator 58 outputs the compensation signal $V_{comp}$ of a logic tow level, which is then fed back to the common voltage adjusting unit 40 to pull-down the voltage level of the common voltage $V_{com}$ in operation S18. Meanwhile, if the output signal of the second voltage detector 56 is greater than that of the first voltage detector 54, as shown in FIG. 9, the voltage comparator 58 outputs the compensation signal $V_{comp}$ of a logic high level, which is then fed back to the common voltage adjusting unit 40 to pull-up the voltage level of the common voltage $V_{com}$ as shown in FIG. 71 in operation S20.

Figure 10:
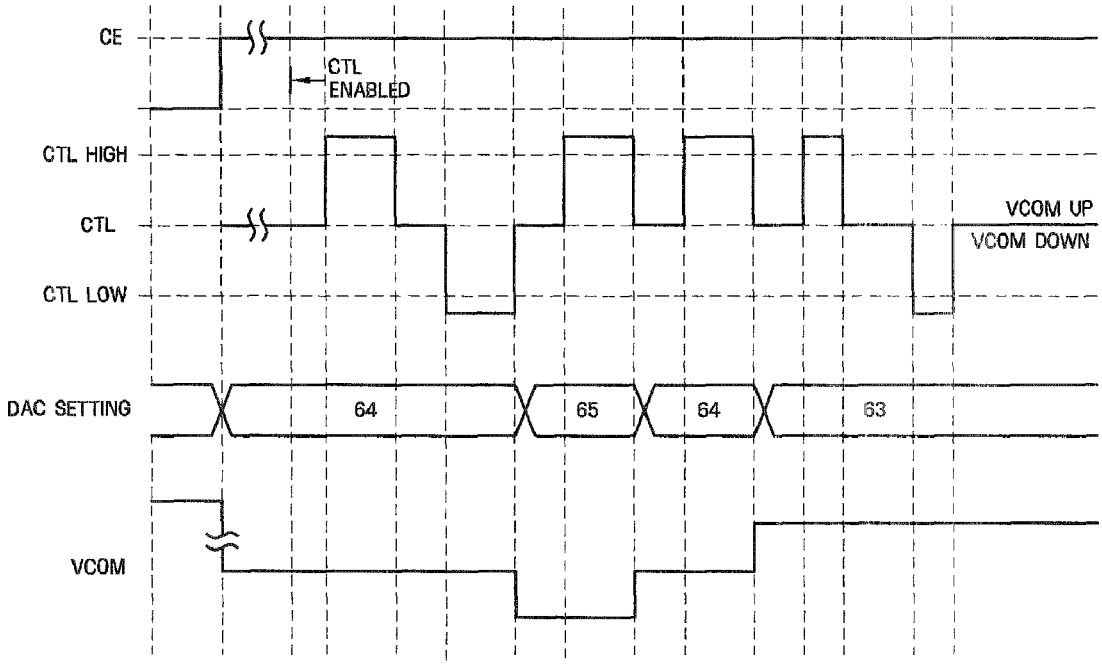
FIG. 10 is a timing diagram of the common voltage adjusting unit according to an exemplary embodiment of the present invention.

FIG. 10 is a timing diagram of the common voltage adjusting unit according to an exemplary embodiment of the present invention.

As shown in FIG. 10, the common voltage adjusting unit 40 receives a control enable signal CE and a control signal CTL from an external device, the control signal CTL is enabled with a lapse of a predetermined delay time. The control signal CTL is a pulse signal having a logic high level and a logic low level. In an exemplary embodiment of the present invention, the operating voltage VDD has a range of about 2.6 V to about 3.6 V, and the control signal CTL has a logic high level and a logic low level on the basis of $V_{DD}/2$. For example, the logic high level of the control signal CTL may have a minimum value of $V_{DD}*0.70$ and a maximum value of $V_{DD}*0.82$, while the logic low level of the control signal CTL may have a minimum value of $V_{DD}*0.20$ and a maximum value of $V_{DD}*0.32$.

Upon receiving the control signal CTL, the interface controller 42 receives a control enable signal CE and a control signal CTL from an external device at an initial operating stage, reads intermediate data stored in the memory 48 according to the control signal CTL, and delivers the read data to the DAC 44. Once the operation of the interface controller 42 is initialized, the interface controller 42 delivers the intermediate data stored in the memory 48 to the DAC 44 according to the compensation signal $V_{comp}$ which is output from the common voltage compensating unit 50.

The DAC 44 outputs an analog voltage value corresponding to the intermediate data read in the memory 48 according to the control signal CTL. The DAC 44 outputs analog voltage values according to the compensation signal $V_{comp}$ which is output from the common voltage compensating unit 50. As shown in FIG. 10, DAC SETTING indicates intermediate data converted by the DAC 44. Here, the intermediate data of bit data, for example, "1000000" as intermediate data of 7-bit data, is stored in the memory 48 at an initial stage. Accordingly, the first data value of the DAC SETTING is 64. Since the compensation signal $V_{comp}$ which is output from the common voltage compensating unit 50 is a logic low level signal, the internal resistance of the DAC 44 increases, so that the second data value of the DAC SETTING is lowered. In addition, since the compensation signal $V_{comp}$ which is output from the common voltage compensating unit 50 is a logic high level signal, the internal resistance of the DAC 44 decreases, so that the third data value of the DAC SETTING rises.

As described above, in the common voltage generation circuit according to an exemplary embodiment of the present invention, the common voltage, the positive polarity data voltage, and the negative polarity data voltage are compared with one another, and a compensation signal is output as the comparison result which is fed back to a common voltage adjusting unit, thereby automatically optimizing the common voltage such that the positive polarity data voltage and the negative polarity data voltage are symmetric with respect to the common voltage. In an exemplary embodiment of the present invention, since the common voltage is automatically optimized, a flicker phenomenon that occurs due to asymmetry of the positive polarity data voltage and the negative polarity data voltage with respect to the common voltage can be automatically adjusted.

Although exemplary embodiments of the present invention have been described in detail with reference to the accompanying drawings for the purpose of illustration, it is to be understood that the inventive processes and apparatus should not be construed as limited thereby. It will be readily apparent to those of ordinary skill in the art that various modifications to the foregoing exemplary embodiments may be made without departing from the scope of the invention as defined by the appended claims, with equivalents of the claims to be included therein.

What is claimed is:

1. A common voltage generation circuit comprising:

a common voltage adjusting circuit that adjusts a level of a common voltage in response to a compensation signal and that provides the adjusted common voltage to a liquid crystal panel; and a common voltage compensating circuit that includes:

an amplifier that amplifies and outputs the adjusted common voltage, a resistor that produces potential differences between the adjusted common voltage and each of positive and negative polarity data voltages output from a data driver, wherein the resistor is connected between an output terminal of the amplifier and an output terminal of the data driver, a first voltage detector that detects across the resistor a potential difference between the adjusted common voltage and the negative polarity data voltage, a second voltage detector that detects across the resistor a potential difference between the adjusted common voltage and the positive polarity data voltage, and a voltage comparator that compares output signals of the first and second voltage detectors and that feeds the compensation signal back to the common voltage adjusting circuit, wherein output signals of the first and second voltage detectors are compared with each other to determine whether the output signal of the first voltage detector is greater than the output signal of the second voltage detector and the compensation signal is output as a result of a comparison of the output signals of the first and second voltage detectors.

2. The common voltage generation circuit of claim 1, wherein feeding the compensation signal back to the common voltage adjusting circuit comprises comparing the positive polarity voltage with the negative polarity voltage to determine whether the positive polarity voltage and the negative polarity voltage are symmetric with respect to the adjusted common voltage.

3. The common voltage generation circuit of claim 1, wherein, when the compensation signal is at a logic low level, the level of the adjusted common voltage is pulled down.

4. The common voltage generation circuit of claim 1, wherein, when the compensation signal is at a logic high level, the level of the adjusted common voltage is pulled up.

5. A liquid crystal display comprising:

a liquid crystal panel including a plurality of unit pixels defined at an intersecting area of each of a plurality of gate lines and each of a plurality of data lines;

a timing controller that generates control signals for controlling the liquid crystal panel;

a driving voltage generator that receives the control signals and that generates a plurality of driving voltages, wherein the driving voltage generator includes:

a common voltage adjusting circuit that adjusts a level of a common voltage in response to a compensation signal and that provides an adjusted common voltage to the liquid crystal panel, an amplifier that amplifies and outputs the adjusted common voltage, a resistor that produces potential differences between the adjusted common voltage and each of positive and negative polarity data voltages output from a data driver, wherein the resistor is connected between an output terminal of the amplifier and an output terminal of the data driver, a first voltage detector that detects across the resistor a potential difference between the adjusted common voltage and the negative polarity data voltage, a second voltage detector that detects across the resistor a potential difference between the adjusted common voltage and the positive polarity data voltage, and a voltage comparator that compares output signals of the first and second voltage detectors and that feeds the compensation signal back to the common voltage adjusting circuit;

a gate driver that receives the driving voltage and that applies the driving voltage to the plurality of the gate lines; and a data driver that applies the data voltage to the plurality of the data lines, wherein output signals of the first and second voltage detectors are compared with each other to determine whether the output signal of the first voltage detector is greater than the output signal of the second voltage detector and the compensation signal is output as a result of a comparison of the output signals of the first and second voltage detectors.

6. The liquid crystal display of claim 5, wherein feeding the compensation signal back to the common voltage adjusting circuit comprises comparing the positive polarity voltage with the negative polarity voltage to determine whether the positive polarity voltage and the negative polarity voltage are symmetric with respect to the adjusted common voltage.

7. The liquid crystal display of claim 5, wherein, when the compensation signal is at a logic low level, the level of the adjusted common voltage is pulled down.

8. The liquid crystal display of claim 5, wherein, when the compensation signal is at a logic high level, the level of the adjusted common voltage is pulled up.

9. The common voltage generation circuit of claim 1, wherein, the first voltage detector and the second voltage detector detect respective potential differences between opposite ends of the resistor.

10. The liquid crystal display of claim 5, wherein, the first and the second voltage detector detect respective potential differences between opposite ends of the resistor.

* * * * *